United States Patent [19]

Miyauchi et al.

[11] 4,120,642

[45] Oct. 17, 1978

[54] METHOD FOR HEATING INGOT IN SOAKING PIT

[75] Inventors: Kohichiroh Miyauchi; Atsushi Ohsumi; Yukio Haga; Tsutomu Izumi; Masahiro Tsuru, all of Fukuyama; Kazuo Kunioka; Shunichi Sugiyama, both of Yokohama, all of Japan

[73] Assignee: Nippon Kokan Kabushiki Kaisha, Tokyo, Japan

[21] Appl. No.: 792,800

[22] Filed: May 2, 1977

[30] Foreign Application Priority Data

May 25, 1976 [JP] Japan ..... 51-59697

[51] Int. Cl.[2] ..... C21D 1/52; F27B 3/02

[52] U.S. Cl. ..... 432/12; 432/18

[58] Field of Search ..... 432/12, 18; 148/134

[56] References Cited

U.S. PATENT DOCUMENTS

| | | | |
|---|---|---|---|
| 2,983,499 | 5/1961 | Sidwell | 432/12 |
| 3,548,171 | 12/1970 | Kody | 432/12 X |
| 3,672,654 | 6/1972 | Knaak | 432/12 X |
| 3,689,041 | 9/1972 | Pere | 432/12 |

*Primary Examiner*—Alan Cohan

*Attorney, Agent, or Firm*—Flynn & Frishauf

[57] ABSTRACT

A steel ingot having a still-liquid portion therein is charged into a soaking pit; then, said ingot is heated by injecting a fuel from a combustion unit of said soaking pit into said soaking pit with a constant and minimum fuel flow rate capable of holding a pit temperature higher by from 10 to 100° C than the cold point temperature of said ingot at the completion of solidification of said still-liquid portion in said ingot, until said still-liquid portion in said ingot is completely solidified; and then, upon the completion of said solidification, the surface portions of said ingot are further heated up to above a prescribed temperature permitting rolling thereof by injecting a fuel from said combustion unit into said soaking pit with a constant fuel flow rate of at least 60% of the maximum fuel flow rate of said combustion unit, thereby reducing the fuel consumption in said soaking pit.

3 Claims, 7 Drawing Figures

1 : PIT TEMPERATURE
2,2' : FUEL FLOW RATE
3 : HOT POINT TEMPERATURE OF INGOT
4 : COLD POINT TEMPERATURE OF INGOT

1 : PIT TEMPERATURE
2,2' : FUEL FLOW RATE
3 : HOT POINT TEMPERATURE OF INGOT
4 : COLD POINT TEMPERATURE OF INGOT

1 : PIT TEMPERATURE
3 : HOT POINT TEMPERATURE OF INGOT
4 : COLD POINT TEMPERATURE OF INGOT
5 : AVERAGE TEMPERATURE OF INGOT

3 : HOT POINT TEMPERATURE OF INGOT
4 : COLD POINT TEMPERATURE OF INGOT
5 : AVERAGE TEMPERATURE OF INGOT

METHOD FOR HEATING INGOT IN SOAKING PIT

FIELD OF THE INVENTION

The present invention relates to a method for heating a steel ingot having a still-liquid portion cast from rimmed steel, capped steel or semi-killed steel in a soaking pit.

BACKGROUND OF THE INVENTION

A steel ingot stripped off from a mold is heated to a prescribed temperature permitting rolling thereof in a soaking pit prior to rolling on a rolling mill.

The following methods for heating a steel ingot in a soaking pit are conventionally known:

(1) Ordinary heating method

This method comprises, as shown in the graph of FIG. 1 representing the temperature (°C) of the soaking pit and the fuel flow rate (l/hr) on the ordinate and the steel ingot retaining time (hr) on the abscissa, first heating a steel ingot by injecting a fuel into a soaking pit with the maximum fuel flow rate of a heavy oil burner or other combustion unit of said soaking pit during the period from the start of heating said ingot charged into said soaking pit until the pit temperature reaches a prescribed set temperature; then, after said pit temperature reaches said set temperature, holding said pit temperature at said set temperature by continuously reducing the fuel flow rate, thereby uniformly heating said ingot to a temperature permitting rolling.

However, because heating of a steel ingot in a soaking pit is governed by the thermal conduction speed from the ingot surface toward the ingot interior, this method has the following difficulties. A large amount of heat is imparted to a steel ingot in the initial stage of heating said ingot in a soaking pit, whereas, as the surface temperature of the ingot rises and approaches a set temperature of the soaking pit, only an amount of heat corresponding to the heat diffusion from the ingot surface toward interior is imparted to the ingot. It is therefore necessary to keep a high pit temperature for a relatively long period of time until heat is diffused sufficiently throughout the interior of ingot. This results in the discharge of large amount of combustion heat to outside the soaking pit in the form of waste gas sensible heat, and hence a very large fuel consumption. To avoid this inconvenience, a measure of slightly decreasing the maximum fuel flow rate is sometimes taken. In this measure, however, there is a delay for the pit temperature in reaching the set temperature, leading to a longer period of ingot retaining time, and no decrease in the fuel consumption is expected.

In this method, as described above, the pit temperature is held at said set temperature by continuously decreasing the fuel flow rate. For this purpose, the fuel flow rate is continuously reduced by continuously measuring the pit temperature and continuously feeding back said measured value to the combustion unit. The amount of air should therefore be adjusted from second to second so as to keep always constant air/fuel ratio in response to this kaleidoscopic change in the fuel flow rate. It is however very difficult to ensure an optimum air/fuel ratio always in response to the change in the fuel flow rate, and it is thus inevitable that this method should be unfavorable in terms of the fuel consumption.

(2) Gradient heating method

This method comprises, as shown in the graph of FIG. 2 representing the temperature (°C) of the soaking pit and the fuel flow rate (l/hr) on the ordinate and the ingot retaining time (hr) on the abscissa, first heating a steel ingot by continuously increasing the fuel flow rate of the combustion unit of a soaking pit so that the pit temperature may rise with a prescribed temperature gradient (°C/hr) during the period from the start of heating said ingot charged into said soaking pit until the pit temperature reaches a prescribed set temperature; then, after said pit temperature reaches said set temperature, holding said pit temperature at said set temperature by continuously reducing the fuel flow rate, thereby uniformly heating said ingot to a temperature permitting rolling thereof.

In this method, the amount of heat input per unit time into the interior of ingot is substantially constant since the temperature distribution in the interior of ingot is smoother than in the aforementioned ordinary heating method. This method therefore permits reduction of the fuel consumption by setting an optimum temperature gradient.

In this method, however, as mentioned above, the pit temperature is gradually raised with a constant temperature gradient up to the set temperature by continuously increasing the fuel flow rate and then continuously decreasing it, thereby holding the pit temperature at said set temperature. For this purpose, the fuel flow rate is continuously increased and then continuously reduced by continuously measuring the pit temperature and continuously feeding back said measured value to the combustion unit. The amount of air should therefore be adjusted from second to second so as to keep always a constant air-fuel ratio in response to this kaleidoscopic change in the fuel flow rate. It is however very difficult to ensure an optimum air/fuel ratio always in response to the change in the fuel flow rate, and it is thus inevitable that this method should be also unfavorable in terms of the fuel consumption, just as the ordinary heating method mentioned above.

As is evident from the above description, in heating a steel ingot in a soaking pit, the fuel consumption can be reduced by always ensuring an optimum air/fuel ratio corresponding to the fuel flow rate. The following methods are known as measures to achieve this:

(a) A method which comprises continuously measuring the oxygen content in waste gas with an oxygen meter, and continuously calculating and setting an optimum air/fuel ratio corresponding to the fuel flow rate in response to said measured value:

This method, permitting reduction of the fuel consumption, has drawbacks of the expensive oxygen meter and the difficulty of maintenance thereof.

(b) A method which comprises increasing and decreasing the fuel flow rate in two stages of high and low during the uniform heating period of ingot, and previously setting an optimum air/fuel ratio in response to said fuel flow rate increased and decreased in said two stages:

In this method, because the fuel flow rate is constant for each stage and there is only two stages, an optimum air/fuel ratio can easily be ensured, thus making it possible to reduce the fuel consumption. This method is however defective in that the pit temperature shows variations.

(c) A method which comprises increasing the fuel flow rate in several stages during the heating period of ingot, and previously setting an optimum air/fuel ratio in response to said fuel flow rate increased in the stages:

In this method which we have tried, an optimum air/fuel ratio can easily be maintained as in the method (b) described above, since the fuel flow rate is constant for each stage, thus permitting reduction of the fuel consumption. However, because it is practically difficult to automatically control the staged increase in the fuel flow rate, this method has a drawback of the necessity of manually controlling said staged increased in the fuel flow rate.

SUMMARY OF THE INVENTION

A principal object of the present invention is therefore to provide a method for heating a steel ingot in a soaking pit, which permits reduction of the fuel consumption.

An object of the present invention is to provide a method for heating a steel ingot in a soaking pit, which effectively utilizes the heat retained in said ingot.

Another object of the present invention is to provide a method for heating a steel ingot in a soaking pit, which permits easy maintenance of an optimum air/fuel ratio corresponding to the fuel flow rate.

Further another object of the present invention is to provide a method for heating a steel ingot in a soaking pit, which leads to a smaller heat loss.

In accordance with one of the features of the present invention there is provided a method for heating a steel ingot in a soaking pit, which comprises:

charging a steel ingot having a still-liquid portion therein into a soaking pit; then, heating said ingot by injecting a fuel from a combustion unit of said soaking pit into said soaking pit with a constant and minimum fuel flow rate capable of holding a pit temperature higher by from 10° to 100° C then the cold point temperature of said ingot at the completion of solidification of said still-liquid portion in said ingot, until said still-liquid portion in said ingot is completely solidified; and then, upon the completion of said solidification, further heating the surface portions of said ingot up to above a prescribed temperature permitting rolling thereof by injecting a fuel from said combustion unit into said soaking pit with a constant fuel flow rate of at least 60% of the maximum fuel flow rate of said combustion unit, thereby reducing the fuel consumption in said soaking pit.

BRIEF DESCRIPTION OF THE DRAWINGS

FIG. 6 (2) is a graph illustrating a typcial temperature distribution in a steel ingot before the completion of solidification of a still-liquid portion in said ingot during heating in a soaking pit in accordance with the method of the present invention.

DETAILED DESCRIPTION OF PREFERRED EMBODIMENTS

With a view to further reducing the fuel consumption in a soaking pit by reveiwing the conventional methods for heating a steel ingot in a soaking pit as described above and also by considering measures to ensure an optimum air/fuel ratio as mentioned above, we have made intensive studies. As a result, it was found that a further reduction of the fuel consumption in a soaking pit can be achieved by heating a steel ingot in the soaking pit with due regards to the following points:

(a) Effective utilization of solidification heat produced during the period before the completion of solidification of a still-liquid portion in the ingot;
(b) Uniform heating of the ingot through heat diffusion from the high-temperature zone in the interior of the ingot; and
(c) Maintenance of a constant optimum air/fuel ratio in response to the fuel flow rate.

The present invention has been made based on aforementioned findings, and the method of the present invention comprises charging a steel ingot having a still-liquid portion therein into a soaking pit; then, heating said ingot by injecting a fuel from a combustion unit of said soaking pit into said soaking pit with a constant and minimum fuel flow rate capable of holding a pit temperature higher by from 10° to 100° C than the cold point temperature of said ingot at the completion of solidification of said still-liquid portion in said ingot, until said still-liquid portion in said ingot is completely solidified; and then, upon the completion of said solidification, further heating the surface portions of said ingot up to above a prescribed temperature permitting rolling thereof by injecting a fuel from said combustion unit into said soaking pit with a constant fuel flow rate of at least 60% of the maximum fuel flow rate of said combustion unit, thereby reducing the fuel consumption in said soaking pit.

Figure 1:
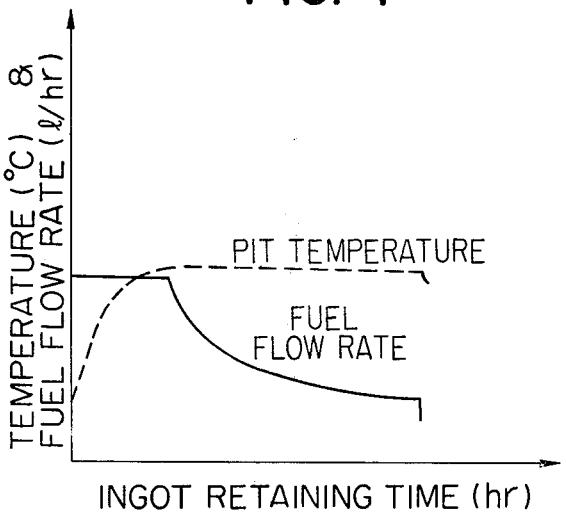
FIG. 1 is a graph illustrating the relation between the pit temperature and the fuel flow rate in the conventional ordinary heating method of a steel ingot in a soaking pit.
Figure 2:
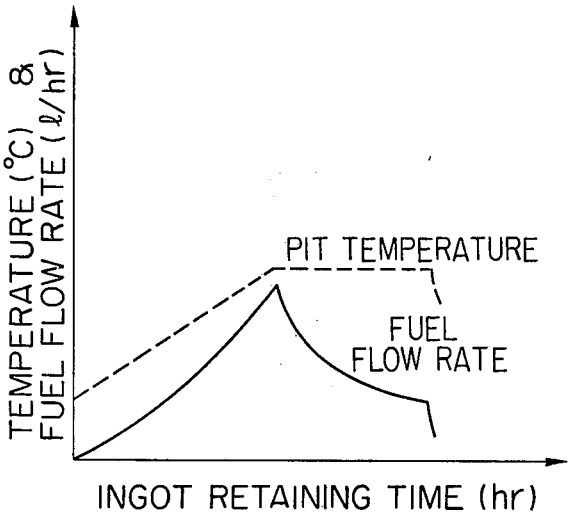
FIG. 2 is a graph illustrating the relation between the pit temperature and the fuel flow rate in the conventional gradient heating method of a steel ingot in a soaking pit.
Figure 3:
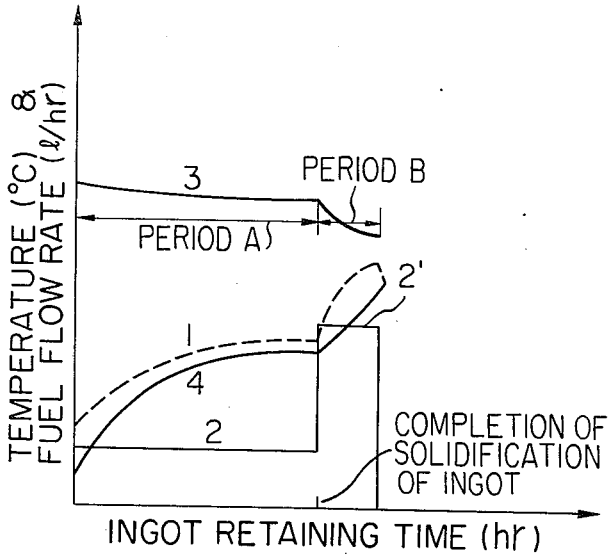
FIG. 3 is a graph illustrating a typical effect of the flow rate on the steel ingot temperature and the pit temperature during the period from the start of heating a steel ingot to the completion of heating, in the method of the present invention for heating a steel ingot in a soaking pit.
Figure 4:
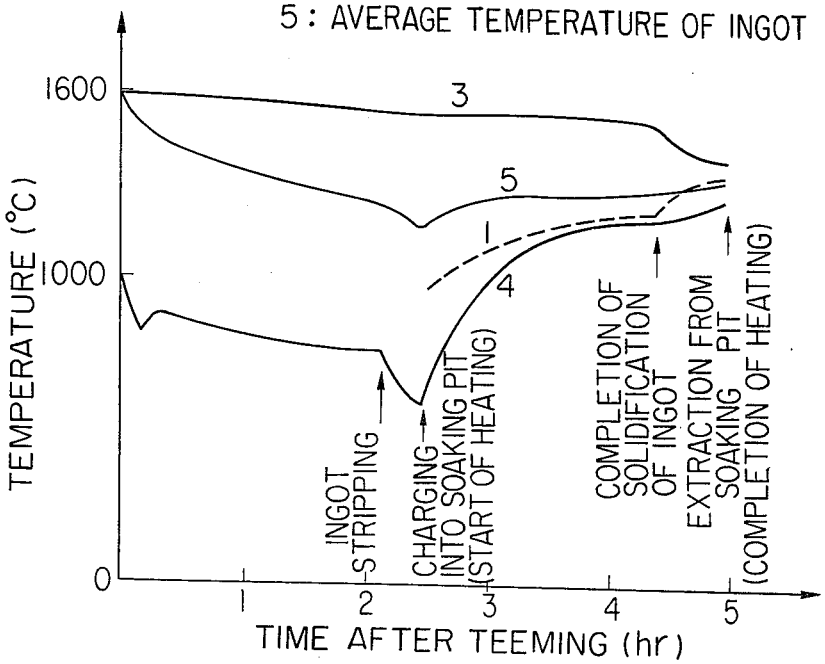
FIG. 4 is a graph illustrating an example of the relation between the steel ingot temperature and the pit temperature during the period from the completion of teeming of molten steel into a mold up to the completion of ingot heating via ingot stripping and ingot charging into a soaking pit, in the method of the present invention for heating a steel ingot in a soaking pit.

Now, the present invention is described in detail with reference to drawings:

FIG. 3 is a graph illustrating a typical effect of the fuel flow rate on the steel ingot temperature and the pit temperature during the period from the start of heating a steel ingot to the completion of heating, in the method of the present invention for heating a steel ingot in a soaking pit, with the temperature (°C) and the fuel flow rate (l/hr) on the ordinate, and the ingot retaining time (hr) on the abscissa. FIG. 4 is a graph illustrating an example of the relation between the steel ingot temperature and the pit temperature during the period from the completion of teeming of molten steel into a mold up to the completion of ingot heating via ingot stripping and ingot charging into a soaking pit, in the method of the present invention for heating a steel ingot in a soaking pit, with the temperature (°C) on the ordinate and the time lapse (hr) from the completion of teeming of molten steel into a mold. In FIGS. 3 and 4, 1 is the line representing the pit temperature; 2 and 2', the fuel flow rate; 3, the hot point temperature of steel ingot; 4, the cold point temperature of steel ingot; and 5, the average temperature of steel ingot. The cold point of steel ingot referred to here means the point at the lowest temperature in a steel ingot. The position of the cold point moves between the surface and the interior of steel ingot during heating the ingot, as described later. The position and the temperature of the cold point of a steel ingot are estimated by the calculation of heat conduction or the like. The hot point of steel ingot means the point at the highest temperature in a steel ingot. In a heated steel ingot, the hot point is located at the ingot center and hardly moves. The position and the temperature of the hot point of a steel ingot are estimated by the calculation of heat conduction or the like. The average temperature of steel ingot is a steel ingot temperature obtained by calculating the heat content per unit weight of a steel ingot by the following formula:

$$\frac{\text{Total heat content of ingot (kcal)}}{\text{Total weight of ingot (kg)}}$$

and converting the result into temperature with reference to a conversion table.

In the present invention, as shown in FIG. 3, a steel ingot having a still-liquid portion therein is first charged into a soaking pit, and then, is heated by injecting a fuel from a combustion unit of said soaking pit into said soaking pit with a constant and minimum fuel flow rate 2 capable of holding a pit temperature 1 higher by from 10° to 100° C than the cold point temperature 4 of said ingot at the completion of solidification of said still-liquid portion in said ingot, until said still-liquid portion is completely solidified. This heating period is hereinafter called the "period A" for heating.

The moment at which a still-liquid portion of a steel ingot is completely solidified is estimated by the calculation of heat conduction or the like.

In the present invention, the fuel flow rate during the period A should be a constant and minimum fuel flow rate capable of holding a pit temperature higher by from 10° to 100° C than the cold point temperature of a steel ingot at the completion of solidification of a still-liquid portion of said ingot, for the following reasons:

(1) In order to reduce the fuel consumption, it is necessary to reduce the amount of injected fuel as far as possible.
(2) In order to reduce the fuel consumption, it is necessary to ensure an optimum air/fuel ratio corresponding to the fuel flow rate throughout the entire period A, and an optimum air/fuel ratio can easily be ensured by employing a constant fuel flow rate.
(3) The fuel consumption can be reduced by fully utilizing the solidification heat produced, as a still-liquid portion in a steel ingot is solidified, for heating said ingot. For this purpose, it suffices to avoid heat discharge from the ingot into soaking pit interior throughout the entire period A.
(4) It is therefore possible to use a smaller amount of heat input from outside by uniformly heating a steel ingot through diffusion of the heat contained in the high-temperature zone in said ingot while supplying a relatively small amount of heat to said ingot to the extent permitting prevention of the heat discharge from the ingot into soaking pit interior. This permits also decrease in the los of combustion heat of fuel in the form of waste gas sensible heat, thereby reducing the fuel consumption.
(5) In view of the reasons (1) to (4) above, it is possible to prevent heat discharge from a steel ingot and yet to minimize the amount of injected fuel by injecting a fuel into a soaking pit, throughout the entire period A, with a constant and minimum fuel flow rate capable of holding a pit temperature higher by from 10° to 100° C than the cold point temperature of said ingot at the end of the period A (i.e., at the completion of solidification of a still-liquid portion in said ingot).

If a steel ingot charged into a soaking pit has a solid ratio of over 80 vol. %, i.e., if said ingot has a liquid ratio of up to 20 vol. %, the heat content of ingot is so small that the length of the period B, which is described below, should be increased to heat said ingot to a temperature permitting rolling thereof. It is therefore desirable that the solid ratio of sad ingot should be up to 80 vol. % and this solid ratio should preferably be as small as possible. In other words, it is desirable that the liquid ratio of said ingot should be at least 20%, and this liquid ratio should preferably be as large as possible. With a solid ratio of said ingot of under 40 vol. %, i.e., with a liquid ratio of said ingot of over 60 vol. %, however, the shell of said ingot is broken and there is a risk of molten steel therein flowing out. This may also cause inner defects of ingot. Therefore, the solid ratio of said ingot should be at least 40 vol. %, i.e., the liquid ratio of said ingot should be up to 60 vol. %.

For these reasons, in the present invention, a steel ingot having a liquid ratio of from 20 to 60 vol. %, preferably of from 40 to 60 vol. %, is charged into a soaking pit furnace.

Then, in the present invention, as shown in FIG. 3, upon the end of the above-mentioned period A, i.e., upon the completion of the still-liquid portion of the ingot, the surface portions of said ingot is further heated up to above a prescribed temperature permitting rolling thereof by injecting a fuel from said combustion unit into said soaking pit with a constant fuel flow rate of at least 60% of the maximum fuel flow rate of said combustion unit of the soaking pit. This period is hereinafter called the "period B" for heating.

In the present invention, the fuel flow rate during said period B should be a constant flow rate of at least 60% of the maximum flow rate of the combustion unit of a soaking pit for the following reasons:

(1) In order to reduce the fuel consumption as mentioned above as to the period A, it is necessary to ensure an optimum air/fuel ratio corresponding to the fuel flow rate throughout the entire period B. An optimum air/fuel ratio can easily be ensured by employing a constant fuel flow rate.

(2) If the amount of injected fuel is set at a value of under 60% of the maximum fuel flow rate of the combustion unit of the soaking pit, the length of the period B for heating the ingot surface portions to a prescribed temperature permitting rolling thereof becomes longer. Furthermore, because a longer period B leads to a larger amount of heat diffusion into the ingot interior and this heats up the ingot interior as well, it is necessary to extend considerably the period B in order to raise the temperature of the ingot surface portions to a temperature permitting rolling thereof, this being unfavorable in terms of the fuel consumption. During the period B, therefore, it is desirable to increase considerably the fuel flow rate such as up to at least 60% of the maximum fuel flow rate of said combustion unit.

As is clear from FIG. 3, the hot point temperature 3 of a steel ingot very slowly decreases during the period A (i.e., up to the completion of solidification of the still-liquid portion in said ingot), whereas it sharply decreases at the beginning of the period B (i.e., immediately after the completion of said solidification). The cold point temperature 4 of the ingot, on the other hand, continues to rise during the period A, and sharply rises during the period B.

The reasons are described in detail below why the period A is followed by period B, i.e., why the ingot surface portions are further heated by largely increasing the fuel flow rate immediately after the completion of solidification of the still-liquid portion in the ingot.

Molten steel at about 1,600° C teemed into a mold is slowly solidified from the surface portions in contact with the mold toward the interior and forms an ingot while discharging solidification heat. At an ingot solid ratio of from about 40 to 60 vol. %, said ingot is stripped off from the mold and then charged into a soaking pit. As shown in the graph of FIG. 4 representing the temperature (°C) on the ordinate and the time lapse after the completion of molten steel teeming into the mold (hr) on the abscissa, the hot point temperature 3 of the ingot very slowly decreases after the completion of teeming into the mold up to the completion of solidification of the still-liquid portion in said ingot, but rapidly decreases upon the completion of said solidification. The cold point temperature 4 of the ingot, on the other hand, slowly decreases from about 1,000° C at the start of molten steel solidification in the mold, and rapidly decreases after stripping. Said cold point temperature 4 rather smoothly increases during the period A after charging the ingot into the soaking pit, and rapidly increases during the period B to reach a prescribed temperature permitting rolling thereof.

During the entire heating period of a steel ingot in a soaking pit and also after the extraction from the soaking pit, the hot point of the ingot is in the center portion of the ingot and hardly moves, whereas the cold point of the ingot frequently moves throughout said entire period. More specifically, the cold point of the ingot is located on the ingot surface until the ingot is charged into the soaking pit, but after charging into the furnace, the ingot surface temperature rises because the pit temperature is higher than the cold point temperature of the ingot, and as a result, the position of the cold point slightly moves from the ingot surface to the interior. At the completion of solidification of the still-liquid portion in said ingot, i.e., at the end of the period A, the cold point returns to the ingot surface. Then, during the period B, the position of the cold point moves again from the ingot surface to the ingot interior since the surface portions of the ingot is heated by largely increasing the fuel flow rate. Upon extraction of the ingot from the soaking pit, the ingot is cooled from the surface thereof. The cold point therefore returns finally to the ingot surface.

Figure 6:
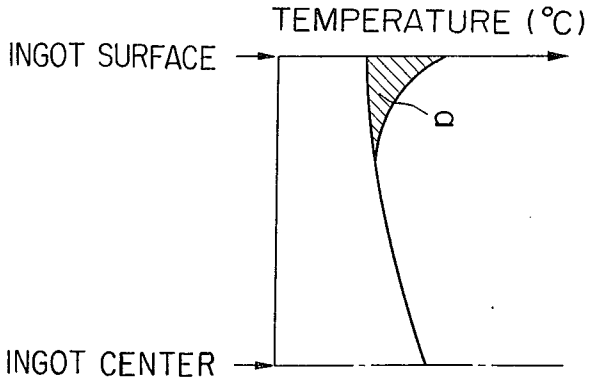
FIG. 6 (1) is a graph illustrating a typical temperature distribution in a steel ingot upon the completion of solidification of a still-liquid portion in said ingot during heating in a soaking pit in accordance with the method of the present invention.
Figure 6:
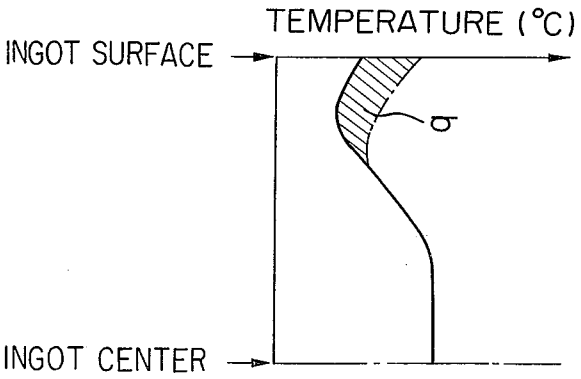

As shown in FIGS. 6(1) and 6(2), therefore, the temperature distribution in a steel ingot during heating in a soaking pit in accordance with the method of the present invention differs between before and after the completion of solidification of the still-liquid portion in the ingot. FIG. 6(1) is a graph illustrating the temperature distribution in a steel ingot at the completion of solidification of the still-liquid portion in the ingot, with the temperature (°C) on the ordinate and the distance from the ingot surface to the ingot center on the abscissa. FIG. 6(2) is a graph illustrating the temperature distribution in the ingot before the completion of solidification of the still-liquid portion in the ingot, with, as in FIG. 6(1), the temperature (°C) on the ordinate and the distance from the ingot surface to the ingot center on the abscissa. As described above, the cold point of a steel ingot is located on the ingot surface at the completion of solidification of the still-liquid portion in the ingot. Therefore, as shown in FIG. 6(1), the temperature distribution in the ingot at this moment shows a gentle increase from the ingot surface, i.e., the cold point toward the ingot center, i.e., the hot point. Before the completion of solidification of the still-liquid portion in the ingot, in contrast, as described above, the cold point of the ingot is located at a slight depth from the ingot surface. Therefore, as shown in FIG. 6(2), the temperature distribution in the ingot shows, not a gentle increase, but a decrease in temperature from the ingot surface toward the cold point and then an increase in temperature from the cold point toward the ingot center, i.e., the hot point.

Figure 5:
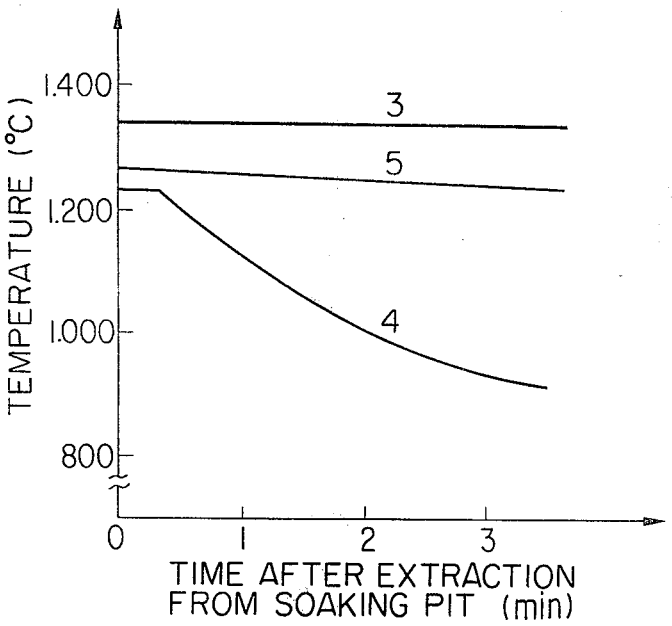
FIG. 5 is a graph illustrating changes in the temperature of a steel ingot with the lapse of time immediately after the extraction of said ingot from a soaking pit after the completion of heating in said soaking pit.

Now, upon extraction of a steel ingot from the soaking pit, as shown in the graph of FIG. 5 with the temperature (°C) on the ordinate and the time lapse (minute) after the extraction of the ingot from the soaking pit on the abscissa, the hot point temperature 3 of the ingot and the average ingot temperature 5 very slowly decrease, whereas only the cold point temperature 4 of the ingot sharply decreases. As mentioned above, the cold point of the ingot after extraction from the soaking pit is located on the ingot surface. This means therefore that only the ingot surface temperature sharply decreases.

In order to avoid the occurrence of surface defects in rolling a steel ingot, which is attributable to the insufficient heat content in the ingot surface portions, therefore, it is necessary to retain a heat content larger than a certain value in the ingot surface portions to make up the temperature drop in these surface portions during the period from the extraction of the ingot out of the soaking pit up to the rolling thereof. For this purpose, in the present invention, the ingot surface portions are heated before extraction from the soaking pit by switching over the fuel flow rate of the combustion unit to the high fuel flow rate. The timing of this switchover of the fuel flow rate should preferably be as early as possible for reducing the fuel consumption. However, before the completion of solidification of the still-liquid portion in the ingot, as described above with reference to FIG. 6(2), the temperature distribution in the ingot does not show a gentle increase in temperature, but the cold point of the ingot is located at a depth from the ingot surface. Therefore, the heat diffises toward the cold point even by heating the ingot surface portions as indicated by a shadowed portion *b* in FIG. 6(2). It therefore takes much time to reach a desired heat content by heating the ingot surface portions, and consequently, the switchover of the fuel flow rate to the high fuel flow rate before the completion of said solidification is unfavorable in terms of the reduction of the fuel consumption.

At the completion of solidification of the still-liquid portion in the ingot, in contrast, as described above with reference to FIG. 6(1), the temperature distribution in the ingot shows a gentle increase in temperature from the ingot surface, i.e., the cold point toward the ingot center, i.e., the hot point. It is therefore possible to ensure a desired heat content in a short period of time and hence to reduce the fuel consumption by heating the ingot surface portions at the completion of solidification of the still-liquid portion in the ingot.

For the reasons described above in detail, in the present invention, the period A is immediately followed by the period B, and the ingot surface portions are heated, as shown by the shadowed portion in FIG. 6(1), by largely increasing the fuel flow rate of the combustion unit at the end of the period A, i.e., at the completion of solidification of the still-liquid portion of the ingot when the cold point of the ingot returns to the ingot surface.

Now, the present invention is described more in detail by way of an example.

EXAMPLE

Twelve capped steel ingots each weighing 15 tons, having a solid ratio of 80 vol. %, i.e., a liquid ratio of 20 vol. % were charged into a soaking pit of the top one-way fired type having a charge capacity of 180 tons which is equipped with a combustion unit having a maximum fuel flow rate of 720 l/hr and is operated with heavy oil as the fuel. Said ingots were heated in compliance with the method of the present invention by keeping a constant fuel flow rate of 120 l/hr (about 17% of said maximum fuel flow rate) for the period A, and a constant fuel flow rate of 600 l/hr (about 83% of said maximum fuel flow rate) for the period B. For comparison purposes, on the other hand, another twelve ingots manufactured under the same conditions with the same properties and dimensions in all respects were charged into the same soaking pit, and were heated in accordance with the conventional ordinary heating method and the gradient heating method described above outside the scope of the present invention.

Values of average fuel consumption obtained by carrying out the above-mentioned three heating methods twenty times each are shown in the following table:

Table

| Heating method | Time from the completion of molten steel teeming into mold up to charging ingot into soaking pit (hr) | Time from charging ingot into soaking pit up to extraction (hr) | Average fuel consumption (kcal/ton) |
|---|---|---|---|
| Method of the present invention | 2.5 | 2.5 | $3.7 \times 10^4$ |
| Ordinary heating method | 2.5 | 2.5/6 | $6.8 \times 10^4$ |
| Gradient heating method | 2.5 | 2.5/6 | $5.5 \times 10^4$ |

As is evident from the table above, in the method of the present invention for heating a steel ingot, the fuel consumption was very largely reduced as compared with those in the conventional methods for heating a steel ingot. Moreover, the ingots heated by the method of the present invention were smoothly rolled, and no defects were observed on both surfaces of the slabs obtained.

According to the method of the present invention, as described above in detail, there are provided the following industrially useful effects:

(1) In the present invention, the fuel flow rate of the combustion unit of the soaking pit is controlled only in two stages of low and high, and the fuel flow rate is constant for each stage. It is not therefore necessary, as in the conventional methods for heating an ingot, to measure the pit temperature of a soaking pit and to control continuously the fuel flow rate by feeding back said measured value to the combustion unit. It is therefore possible to conduct stable heating of an ingot.

(2) Because the fuel flow rate is constant in the present invention, it is very easy to ensure an optimum air/fuel ratio.

(3) The pit temperature of a soaking pit during the period A in the present invention is lower than those in the conventional methods, thus leading to a smaller heat loss from the pit walls.

(4) Since the fuel flow rate is small during the period A in the present invention, the temperature distribution in the soaking pit, particularly in an one-way fired soaking pit, is more uniform than in the conventional methods.

(5) As a result of the effects (1) to (4) above, according to the method of the present invention, it is possible to largely reduce the fuel consumption as well as to avoid the occurrence of surface defects caused by the insufficient heat content in the ingot surface portions when rolling the heated ingot.

What is claimed is:

1. A method for heating a steel ingot in a soaking pit, which comprises:

charging a steel ingot having a still-liquid portion therein into a soaking pit; then, heating said ingot by injecting a fuel from a combustion unit of said soaking pit into said soaking pit with a constant and minimum fuel flow rate capable of holding a pit temperature higher by from 10° to 100° C than the cold point temperature of said ingot at the completion of solidification of said still-liquid portion in said ingot, until said still-liquid portion in said ingot is completely solidified; and then, upon the completion of said solidification, further heating the surface portions of said ingot up to above a prescribed temperature permitting rolling thereof by injecting a fuel from said combustion unit into said soaking pit with a constant fuel flow rate of at least 60% of the maximum fuel flow rate of said combustion unit, thereby reducing the fuel consumption in said soaking pit.

2. The method as claimed in claim 1, wherein said still-liquid portion in said ingot is within a range from 20 to 60 vol. % of said ingot.

3. The method as claimed in claim 1, wherein said still-liquid portion in said ingot is within a range from 40 to 60 vol. % of said ingot.

* * * * *